US007926652B2

(12) United States Patent
Escamilla et al.

(10) Patent No.: US 7,926,652 B2
(45) Date of Patent: Apr. 19, 2011

(54) CIGARETTE DISPENSER

(76) Inventors: Manuel Escamilla, Westlake, LA (US); Damien Escamilla, Westlake, LA (US)

( * ) Notice: Subject to any disclaimer, the term of this patent is extended or adjusted under 35 U.S.C. 154(b) by 0 days.

(21) Appl. No.: 12/216,551

(22) Filed: Jul. 8, 2008

(65) Prior Publication Data

US 2010/0006457 A1 Jan. 14, 2010

(51) Int. Cl.
*B65D 85/10* (2006.01)

(52) U.S. Cl. ..... 206/86; 206/236; 206/259; 224/666

(58) Field of Classification Search ..... 206/37, 206/38, 86, 87, 94, 236, 242, 243, 248, 259, 206/276; 131/178; 224/191, 587, 605, 666, 224/679, 681

See application file for complete search history.

(56) References Cited

U.S. PATENT DOCUMENTS

| | | | | |
|---|---|---|---|---|
| 2,090,700 | A | 8/1937 | Power | |
| 2,472,344 | A | 6/1949 | Rosenbarger | |
| 2,506,600 | A | 5/1950 | Kassovil | |
| 2,597,990 | A | 5/1952 | Hellman | |
| 2,856,098 | A | 10/1958 | Geisel | |
| 2,919,018 | A * | 12/1959 | Allen | 206/95 |
| 3,100,060 | A | 8/1963 | Calixto | |
| 4,190,148 | A * | 2/1980 | Schade et al. | 206/89 |
| 4,275,819 | A | 6/1981 | Perez | |
| 4,363,432 | A * | 12/1982 | Warthen | 224/666 |
| 4,667,688 | A * | 5/1987 | Roig et al. | 206/242 |
| 4,852,729 | A | 8/1989 | Conte | |
| 5,277,315 | A * | 1/1994 | Plein | 206/270 |
| 5,462,212 | A * | 10/1995 | Hertel, Jr. | 206/86 |
| 5,489,078 | A | 2/1996 | Risley | |
| 5,711,423 | A * | 1/1998 | Fuller, Jr. | 206/246 |
| 6,223,891 | B1 | 5/2001 | Devens et al. | |

* cited by examiner

*Primary Examiner* — Luan K Bui

(57) ABSTRACT

A cigarette dispenser including a box for holding a number of cigarettes. The box has an open bottom that defines a discharge opening for cigarettes held within the box. A U-shaped cradle is affixed to the box adjacent the discharge opening for catching cigarettes as such pass from the discharge opening. A mounting clip is affixed to the box for releasably securing the box to a support.

1 Claim, 2 Drawing Sheets

CIGARETTE DISPENSER

FIELD OF THE INVENTION

The present invention relates generally to article dispensers having tiltable containers with traps.

BACKGROUND OF THE INVENTION

Many people enjoy smoking cigarettes while driving. Unfortunately, hunting for a pack of cigarettes while operating a moving vehicle can be hazardous. Sometimes the removal of a seatbelt is required to access a remote glove box, a purse, or clothing pockets that may contain a cigarette pack. Not only driving without a seatbelt universally recognized as being a criminal activity, but taking one's eyes off the road to carry out a search for cigarettes substantially increases the likelihood of the driver causing a crash and injuring himself or others.

SUMMARY OF THE INVENTION

In light of the problems associated with searching for packs of cigarettes while operating land vehicles, it is a principal object of the invention to provide a cigarette dispenser that can be mounted upon a conventional, sun visor of a land vehicle so that the driver of the vehicle can easily retrieve a cigarette without taking his eyes from the road. The dispenser also releasably holds a cigarette lighter for the convenient and safe ignition of the cigarette.

It is another object of the invention to provide a cigarette dispenser of the type described that is easy to fill with cigarettes and that employs gravity to move these cigarettes to an easily accessed, retrieval position in the dispenser.

It is a further object of the invention to provide a cigarette dispenser that is easy to use while driving and, prior to taking a road trip, can be loaded and installed in a land vehicle by one person with minimal instruction and without resort to any additional tools. The cigarette dispenser is intuitive to use.

It is an object of the invention to provide improved features and arrangements thereof in a cigarette dispenser for the purposes described which is lightweight in construction, inexpensive to manufacture, and dependable in use.

Briefly, our cigarette dispenser achieves the intended objects by featuring a box for holding a number of cigarettes. The box includes: a back wall, a front wall with an observation opening, a top wall, opposed side walls with refill ports for admitting cigarettes into the box, and an open bottom defining a discharge opening for removing cigarettes from the box. A U-shaped cradle is affixed to the box adjacent the discharge opening for catching cigarettes as they pass through the discharge opening under the influence of gravity. A transparent window is affixed to the front wall so as to close the observation opening. A mounting clip is affixed to the box for releasably securing the box to a sun visor of a land vehicle. The mounting clip is capable of engaging the sun visor and pressing such against the back wall of the box. A spacer is affixed to the back wall for distancing the discharge opening from the sun visor. A pair of clasps is affixed in a spaced-apart relationship to one of the side walls for releasably securing a cigarette lighter to the box.

The foregoing and other objects, features, and advantages of the cigarette dispenser will become readily apparent upon further review of the following detailed description as illustrated in the accompanying drawings.

BRIEF DESCRIPTION OF THE DRAWINGS

The cigarette dispenser can be more readily understood with reference to the accompanying drawings, in which.

Similar reference characters denote corresponding features consistently throughout the accompanying drawings.

DETAILED DESCRIPTION OF THE PREFERRED EMBODIMENT

Figure 1:
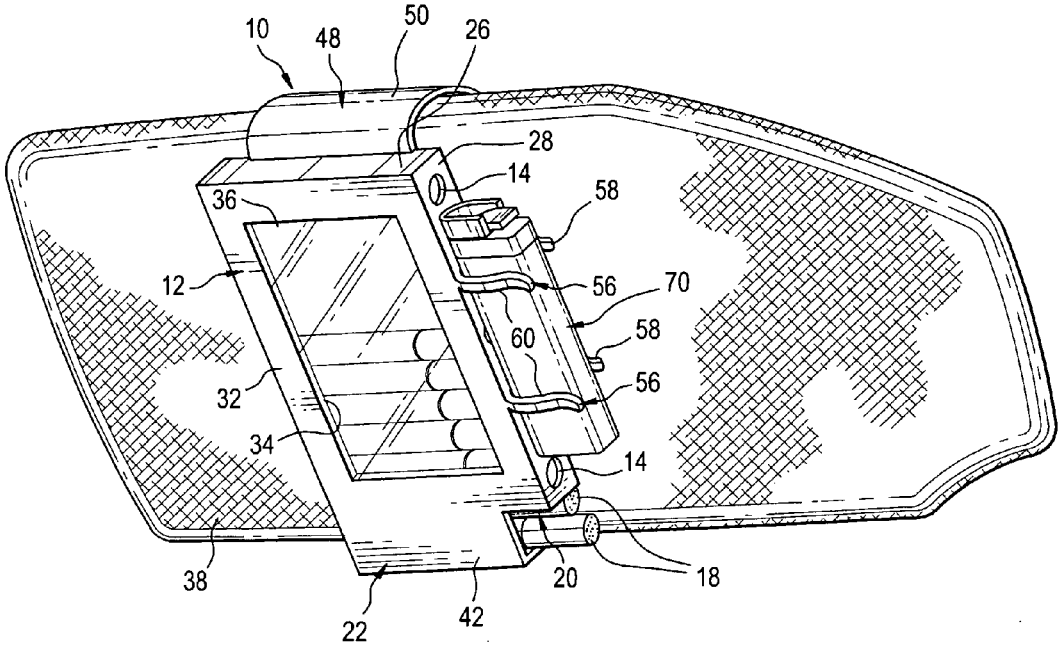
FIG. 1 is a perspective view of a cigarette dispenser in accordance with the present invention shown mounted upon the sun visor of a land vehicle.
Figure 2:
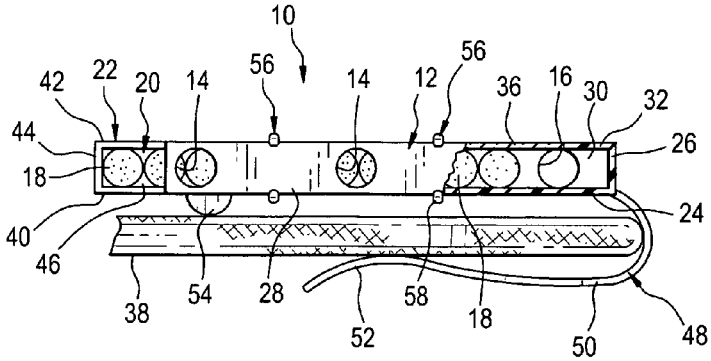
FIG. 2 is a side elevational view of the cigarette dispenser with portions broken away to reveal details thereof.
Figure 3:
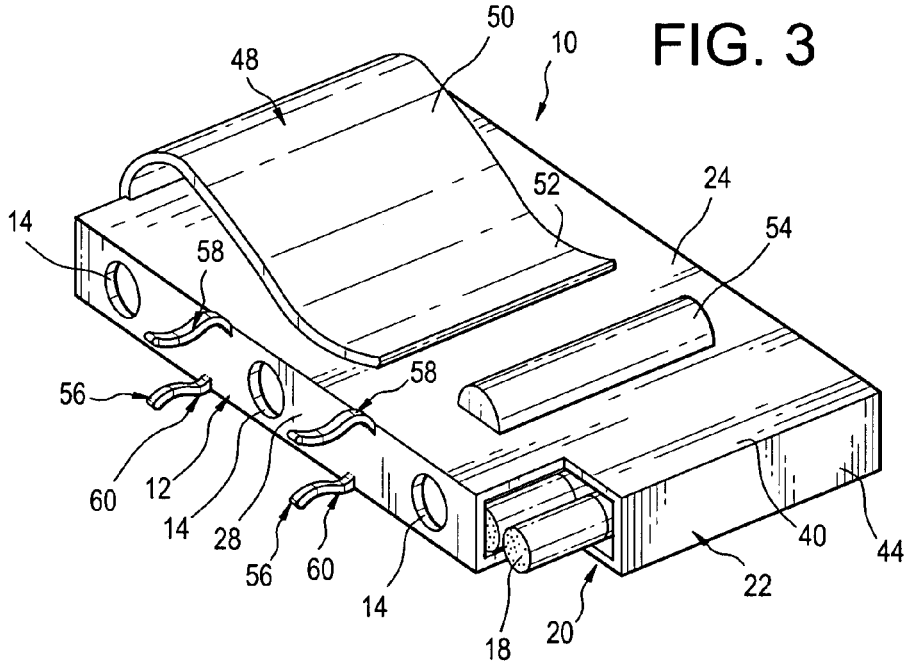
FIG. 3 is a perspective view showing principally the rear of the cigarette dispenser.
Figure 4:
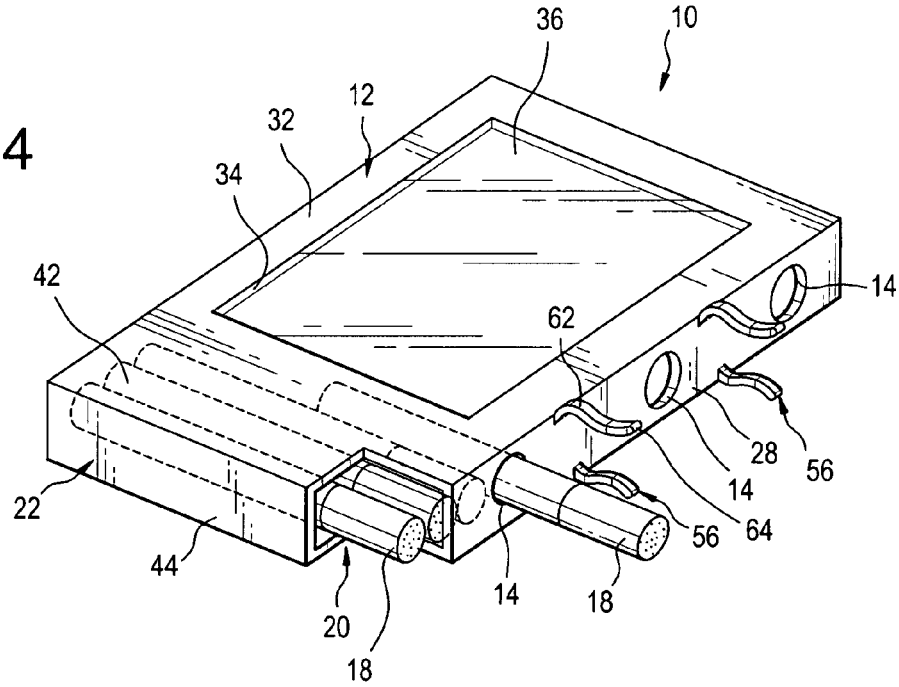
FIG. 4 is a perspective view showing principally the front of the cigarette dispenser.

Referring now to the FIGS., a cigarette dispenser in accordance with the present invention is shown at 10. Dispenser 10 includes a box 12 dimensioned to hold a plurality of cigarettes 18 stacked one atop the other. Box 12 is provided with a number of refill ports 14 and 16 through which cigarettes 18 can be moved into box 12. A discharge opening 20 is provided in the bottom of box 12 through which cigarettes 18 are dispensed from the box 12 under the influence of gravity. A U-shaped cradle 22 is affixed to box 12 adjacent discharge opening 20 for catching a cigarette 18 as it passes from discharge opening 20 and for holding a cigarette 18 until it is grasped and taken away by a user.

Box 12 is five-sided and has a flat, rectangular shape. As such, box 12 has a rectangular, back wall 24. A rectangular, top wall 26 is affixed to, and projects forwardly from, the top of back wall 24. A first, rectangular, side wall 28 is affixed to, and projects forwardly from one of the opposite sides of back wall 24. A second, rectangular, side wall 30 is affixed to, and projects forwardly from the remaining side of back wall 24. Side walls 28 and 30 connect to top wall 26 and have the same height as top wall 26, being slightly greater in size than the diameter of a cigarette 18. A rectangular, front wall 32, having the same dimensions as back wall 24, is joined to the remainder of box 12 such that its top is affixed to the front of top wall 26 and its opposite sides are affixed to the fronts of side walls 28 and 30.

Front wall 32 is provided with a rectangular, observation opening 34. Opening 34 extends substantially from the top of front wall 32 to the bottom of front wall 32 as well as from one side of front wall 32 to the other. A transparent window 36 is affixed to front wall 32 so as to close opening 34, keep cigarettes 18 clean, and retain cigarettes 18 within box 12. Most of the cigarettes 18 held within box 12 at any given point in time can be viewed through window 36.

Three, refill ports 14 are provided in side wall 28 for inserting cigarettes 18 into box 12. Ports 14 are provided at spaced apart locations, one being located proximate the top of side wall 28, another being located adjacent the bottom of side wall 28, and the remaining port 14 being located at the middle of side wall 28. Each of ports 14 has a diameter that is slightly greater than that of a cigarette 18 so that, once cigarettes 18 are inserted into box 12, cigarettes 18 cannot easily be shaken out of box 12 by the typical vibrations and motions of visor 38 as its associated land vehicle is driven around.

Three, refill ports 16 are provided in side wall 30 for inserting cigarettes 18 into box 12. One of ports 16 is located proximate the top of side wall 30. Another of ports 16 is located near the bottom of side wall 30. The third port 16 is located at the middle of side wall 30 between the other two ports 16. Ports 16 are sized like ports 14, having diameters somewhat greater than that of cigarettes 18. With ports 14 and 16 being located on the opposite sides of box 12, right- and left-handed users will have no difficulty recharging dispenser 10 with cigarettes 18.

Cradle 22 is formed by providing back wall 24 and front wall 32 with retaining tabs respectively shown at 40 and 42. As illustrated, tabs 40 and 42 are rectangular in outline and are of like size. Tabs 40 and 42 extend downwardly from walls 24 and 32 for a distance that is slightly greater than the diameter of a cigarette 18. Tabs 40 and 42 also extend from the bottom left corners of walls 40 and 42 (as seen in FIG. 1) somewhat more than half way toward the bottom right corners of walls 40 and 42 so as to provide access to a portion of discharge opening 20 that has sufficient size for the fingers of a user to grasp a cigarette 18.

Cradle 22 includes a rectangular, bottom wall 44 that connects together the bottoms of tabs 40 and 42. Bottom wall 44 extends the full length of tabs 40 and 42 and has the same height as walls 26, 28, and 30. By partially closing opening 20 at the bottom of box 12, bottom wall 44 serves to retain cigarettes 18 within box 12 until such time as a user chooses to smoke one of them.

Cradle 22 further includes an end cap 46 for preventing a cigarette 18 from sliding beneath side wall 30. End cap 46 extends downwardly from side wall 30 for a distance that is somewhat greater than the diameter of a cigarette 18. The bottom of end cap 46 connects to bottom wall 44. The back of end cap 46 connects to tab 40, and the front of end cap 46 connects to tab 42.

An S-shaped mounting clip 48 is affixed to box 12 for grasping a land vehicle, sun visor 38. Clip 48 has a leg 50 that is concave relative to back wall 24 and has a foot 52 that is convex relative to back wall 24. The top of leg 50 is affixed to the top of back wall 24. The top of foot 52, however, is affixed to the bottom of leg 50. During use, foot 52 serves to guide visor 38 between leg 50 and back wall 24 so as so securely, yet releasably, suspend dispenser 10 to visor 38.

A spacer 54 is affixed to the bottom of back wall 24 for distancing cradle 22 from visor 38 so that a cigarette 18 can be more easily gripped by the fingers of a user. As shown, spacer 54 is a bar that extends from a point near side wall 28 to a point near side wall 30. Spacer 54 has a height that is substantially equal to the diameter of a cigarette 18.

A pair of clasps 56 is affixed to side wall 28 for releasably securing a cigarette lighter 70 to box 12. Each of clasps 56 includes a pair of opposed, S-shaped arms 58 and 60, each having an inner, forearm portion 62 and an outer, finger portion 64 extending outwardly from a forearm portion 62. The inner ends of portions 62 of arms 58 are affixed to the back of side wall 28 whereas the inner ends of portions 62 of arms 60 are affixed to the front of side wall 28. Forearm portions 62 of each clasp 56 are concave relative to one another and finger portions 64 of each clasp 56 are convex relative to one another. Finger portions 64 serve to guide lighter 70 between forearm portions 62 where lighter 70 is effectively grasped.

With the exception of window 36, dispenser 10 is molded as a unitary whole from a suitable thermoplastic material. The material is resilient to the extent necessary to permit clip 48 and clasps 56 to flex to gain a grip upon visor 38 and lighter 70. Window 36, however, can be made from a transparent plastic material that need not possess the ability to flex. After window 36 is independently formed, is can be affixed within opening 34 by adhesive cement or other suitable means.

From the foregoing, it will be appreciated that charging the dispenser 10 is straightforward. First, box 12 is fastened to the top of sun visor 38 by sliding such beneath clip 48. Next, cigarettes 18 are inserted into box 12 by sliding them through ports 14 and 16. (Box 12 can be dimensioned to receive the contents of an entire pack of cigarettes 18 thereby allowing a user to easily keep track of his consumption of cigarettes 18, if desired.) Finally, lighter 70 is pushed between arms 58 and 60 so that clasp 56 grasps the top of lighter 70 and another clasp 56 grasps the bottom of lighter 70.

Cigarettes 18 are pulled downwardly by gravity into cradle 22. A user need only pull a cigarette 18 from opening 20 with his fingers to gain control over the cigarette 18. By similarly pulling lighter 70 from clasps 56, the user can easily light the cigarette 18 after lighter 70 is fired. There is never any need for the user to take his eyes from the road to access a cigarette 18 or lighter 70. Thus, dispenser 10 can be safely used while the vehicle carrying visor 38 is in motion.

While dispenser 10 has been described with a high degree of particularity, it will be appreciated by those skilled in the art that modifications can be made to it. Therefore, it is to be understood that the present invention is not limited solely to dispenser 10 but encompasses any and all dispensers within the scope of the following claims.

We claim:

1. A cigarette lighter, comprising:

a box for holding a plurality of cigarettes, said box including: a back wall, a front wall with an observation opening therein, a top wall, opposed side walls with a plurality of refill ports therein for admitting cigarettes into said box, and an open bottom defining a discharge opening for removing cigarettes under the influence of gravity from said box;

a U-shaped cradle being affixed to said box adjacent said discharge opening for catching cigarettes as such pass from said discharge opening;

a transparent window being affixed to said front wall so as to close observation opening;

a mounting clip being affixed to said box for releasable securing said box to a sun visor of a land vehicle, said mounting clip being capable of engaging the sun visor and pressing such against said back wall;

a spacer being affixed to said back wall and extending outwardly therefrom for distancing said discharge opening from the sun visor; and, a pair of clasps being affixed in a spaced-apart relationship to one of said opposed side walls for releasable securing a cigarette lighter to said box.

* * * * *